United States Patent [19]

Jelinek

[11] Patent Number: 4,840,129

[45] Date of Patent: Jun. 20, 1989

[54] PYROLYSIS SYSTEM

[75] Inventor: Horst Jelinek, Offenbach, Fed. Rep. of Germany

[73] Assignee: Siemens Aktiengesellschaft, Berlin and Munich, Fed. Rep. of Germany

[21] Appl. No.: 103,410

[22] Filed: Sep. 30, 1987

[30] Foreign Application Priority Data

Sep. 30, 1986 [DE] Fed. Rep. of Germany ..... 3633212

[51] Int. Cl.[4] ..... F23G 5/12

[52] U.S. Cl. ..... 110/229; 48/111; 48/DIG. 1; 110/226; 110/246

[58] Field of Search ..... 110/229, 230, 246, 226; 48/76, 203, DIG. 1, 209, 111

[56] References Cited

U.S. PATENT DOCUMENTS 3,098,458 7/1963 Lantz, Jr. .
4,164,397 8/1979 Hunt et al. ..... 48/DIG. 1
4,306,506 12/1981 Rotter ..... 110/229
4,437,418 3/1984 Guillaume et al. ..... 110/246
4,557,204 12/1985 Faehnle ..... 110/229 XR
4,678,480 7/1987 Heinrich et al. ..... 48/DIG. 1

FOREIGN PATENT DOCUMENTS 2713031 10/1978 Fed. Rep. of Germany .
3412583 10/1985 Fed. Rep. of Germany .

*Primary Examiner*—Edward G. Favors
*Attorney, Agent, or Firm*—Herbert L. Lerner; Laurence A. Greenberg

[57] ABSTRACT

A pyrolysis system for trash and refuse utilization having a heated low temperature carbonization drum with a device for feeding material to be carbonized located at one end face of the drum, a residue discharge device at the other end face of the drum, a low temperature carbonization gas exhaust, and a gas converter connected to the low temperature carbonization gas exhaust for converting the low temperature carbonization gas into cracked gas, includes means for supplying to the low temperature carbonization drum part of a quantity of cracked gas flowing out of the gas converter as a heat carrier.

9 Claims, 1 Drawing Sheet

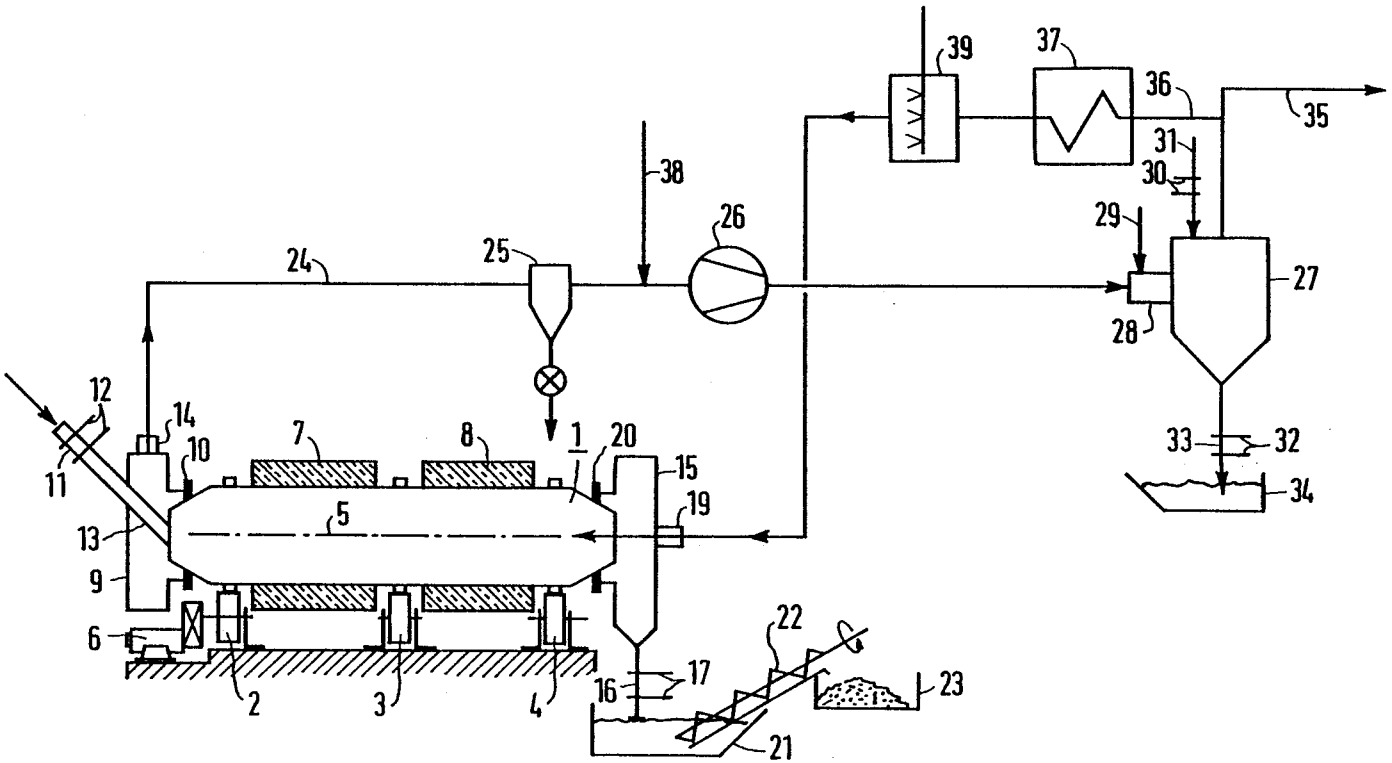
35
27
32
34
36
31
30
33
29
28
37
39
23
22
21
26
38
15
19
17
20
16
1
25
4
8
3
5
24
7
2
14
10
12
13
9
6
11

PYROLYSIS SYSTEM

The invention relates to a pyrolysis system for refuse and trash utilization having a heated low temperature carbonization drum with a device for feeding material to be carbonized at one end face of the low temperature carbonization drum, a residue discharge device at the other end face of the low temperature carbonization drum, a low temperature carbonization gas exhaust, and a gas converter connected to the low temperature carbonization gas exhaust for converting the low temperature carbonization gas into cracked gas.

In heretofore known pyrolysis systems, the material to be subjected to low temperature carbonization, generally, comminuted trash and refuse materials, is carbonized at 400°-500° C. in a slowly rotating, heated low temperature carbonization drum. The low temperature carbonization gas thereby produced is exhausted, made dust-free and converted in a so-called gas converter into industrially exploitable cracked gas. It has also become known from German Published, Non-Prosecuted Application No. 34 12 583 to provide the low temperature carbonization drum with heating tubes in its interior for heating the material fed into it for carbonization, and to conduct a separately generated heating gas through these heating tubes. It is a feature of this type of pyrolysis system that the low temperature carbonization drum, which is generally operated with a slight negative pressure and rotates slowly, has to be sealed off with sealing rings at both of its open end faces, respectively, from a stationary housing for feeding the materials to be carbonized and from a residue discharge housing. Furthermore, additional sealing rings are required for connecting a low temperature carbonization gas line and coupling heating tube connections to the low temperature carbonization drum. These sealing rings, which must also absorb temperature-dependent axial changes in length of the low temperature carbonization drum, are subject to severe wear at the prevailing operating conditions, given the relatively high temperatures, the load of dust and the action of the aggressive gases, and must be replaced at relatively short time intervals. Each time the sealing rings are replaced, the system must be shut down. The heating tubes disposed in the interior of the drum also undergo marked wear because of the solids entrained with the material to be carbonized, and must be replaced from time to time. Furthermore, in this heretofore known system, a separate combustion chamber must be provided for generating the hot gases.

From German Pat. No. 27 13 031, a low temperature carbonization drum has also become known which does not require vulnerable heating tubes nor a separate combustion chamber for generating the hot gases. Instead the exhaust gases of a power output machine, i.e. an internal combustion engine operated with cracked gas, are used as the heating gas. Also, the spiral-shaped blades that effect the axial feeding of the material to be carbonized in the interior of the drum are constructed as hollow bodies, and the exhaust gas flows through them. The servicing intervals in this heretofore known system are determined by the numerous sealing rings needed at both ends of the drum.

It is accordingly an object of the invention to provide a pyrolysis system in which the expense for heating the material to be carbonized as well as servicing intervals and maintenance costs are reduced from that of heretofore known systems of this general type.

With the foregoing and other objects in view there is provided, in accordance with the invention, a pyrolysis system for trash and refuse utilization having a heated low temperature carbonization drum with a device for feeding material to be carbonized located at one end face of the drum, a residue discharge device at the other end face of the drum, a low temperature carbonization gas exhaust, and a gas converter connected to the low temperature carbonization gas exhaust for converting the low temperature carbonization gas into cracked gas, comprising means for supplying to the low temperature carbonization drum part of a quantity of cracked gas flowing out of the gas converter as a heat carrier.

In accordance with another feature of the invention, there are provided means for conducting through the drum the cracked gas supplied to the drum for directly heating the material to be carbonized in counterflow to the material, and means for exhausting together the thus spent cracked gas with the low temperature carbonization gas.

In accordance with further feature of the invention, there are provided means for conducting the cracked gas supply to the drum through a heat exchanger preceding the drum on the cracked gas side, for reducing the temperature of the cracked gas.

In accordance with an additional feature of the invention, there are provided means for injecting water into the cracked gas flowing to the drum for reducing the temperature of the cracked gas flowing to the drum.

In accordance with an added feature of the invention, there is provided a dust precipitator built into a low temperature carbonization gas line leading from the drum to said gas converter.

In accordance with yet another feature of the invention, the dust precipitator is a cyclone.

In accordance with yet a further feature of the invention, there are provided hollow lines communicating with the drum for supplying the cracked gas for indirectly heating the drum.

In accordance with yet an additional feature of the invention, the hollow lines are formed of half-round profile sections welded to the outer wall of the drum.

In accordance with yet an added feature of the invention, a thermal insulator envelops the drum in a circumferential region thereof.

In accordance with a concomitant feature of the invention, there are provided means for feeding combustion gas derived from outside the system into the low temperature carbonization gas line, for starting up the system.

Because of the use of part of the unburned cracked gas for heating the material to be carbonized in the low temperature carbonization drum, the heat required for the low temperature carbonization process is furnished at the minimum possible expense and without combustion of cracked gas or supplying external heating energy.

In an especially desirable embodiment of the invention, the cracked gas supplied to the low temperature carbonization drum flows in a counterflow through the drum for direct heating of the material to be carbonized and is exhausted with the low temperature carbonization gas. This not only has the advantage of reducing the heat losses as compared with indirect heating, but above all means that the number of seals at the two end face of the drum can, respectively, be reduced to a minimum.

The balance of energy in the pyrolysis system is improved if, in accordance with another embodiment of the pyrolysis system of the invention, the cracked gas supplied to the drum for temperature reduction is conducted through a heat exchanger that is connected ahead or upstream of the drum on the cracked gas side thereof. The cracked gas is cooled in the heat exchanger to approximately 550° C. In this manner valuable high-temperature energy is liberated and, at the same time, overheating of the drum is prevented.

Other features which are considered as characteristic for the invention are set forth in the appended claims.

Although the invention is illustrated and described herein as embodied in pyrolysis system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single figure of the drawing which is a diagrammatic and schematic view of the pyrolysis system according to the invention.

Referring now to the figure of the drawing, there is shown therein a low temperature carbonization drum 1. It is open at both end faces thereof and is rotatable about its longitudinal axis 5 on roller bearings 2, 3 4. An electric motor 6 is provided for driving it. Between the roller bearings 2, 3, 4, the low temperature carbonization drum 1 is provided with a thermal insulation 7, 8. On the end face of the drum 1 shown at the left-hand side of the figure, a housing 9 for feeding material to be carbonized can be seen placed over the end face of the drum 1 and connected gas-tightly to the drum 1 with a ring seal 10. This housing 9 for feeding material to be carbonized carries a feeding device 11 for the material to be carbonized, the feeding device having a gas-tight sluice 12 and a low temperature carbonization gas exhaust pipe 14. A residue discharge housing 15 is placed over the end face of the drum 1 at the right-hand side of the figure and, at its lower and, this housing 15 has a residue discharge device 16 with a gas-tight sluice 17 and a cracked gas connection pipe 19. The residue discharge housing 15 is likewise connected to the drum 1 in a gas-tight manner via a ring seal 20. Below the residue discharge device 16, a water-filled collection vessel 21 for the residue, and a transport screw 22 projecting into the collection vessel 21 for removing the discharged residue and feeding it into a transport container 23 can be seen.

Connected to the low temperature carbonization gas discharge pipe 14 of the housing 9 for feeding the material to be carbonized is a low temperature carbonization gas line 24, which leads to a cyclone 25 and, from there, via a gas compressor 26, to a gas converter 27. This gas converter 27 has a combustion chamber 28, to which the low temperature carbonization gas line 24 and a fresh air line 29 are connected. The gas converter 27 also has a coke charging device 31, sealed off by a sluice 30, as well as a low temperature carbonization coke discharge device 33, likewise sealed off by a sluice 32, and discharging into a water bath 34 when the sluice 32 is open. Branching from a cracked gas line 35 leaving the gas converter 27 is a further cracked gas line 36, which extends via a heat exchanger 37 towards and is connected to a cracked gas pipe union 19 of the residue discharge housing 15. In the low temperature carbonization gas line 24 leading from the cyclone 25 to the gas compressor 26 and to the combustion chamber 28 of the gas converter 27, there is a pipe union 38 for an externally supplied combustion gas, e.g. city or public gas, for the case at hand.

When the pyrolysis system is put into operation, city or public gas is carried via the pipe union 38 of the low temperature carbonization gas line 24 into the combustion chamber 28 of the gas converter 27 and consumed there substoichiometrically. That means that partly burned city gas leaving the gas converter 27 travels via the heat exchanger 37 and the cracked gas pipe union 19 into the residue discharge housing 15 of the drum 1 and from there into the drum 1 in counterflow to the material to be carbonized. In this regard, the material to be carbonized, which is continuously turned over and over in the drum 1, is heating to the low temperature carbonization temperature of approximately 450° C. to 500° C. The low temperature carbonization gas thus liberated is sucked by the gas compressor 26 together with the city gas via the housing 9 for feeding the material to be carbonized and via the low temperature carbonization gas line 24 into the cyclone 25, where it is freed from dust and is then forced farther on into the combustion chamber 28 of the gas converter 27. In the combustion chamber 28 of the gas converter 27, the low temperature carbonization gas is burned with air admixed in a substoichiometric ratio. The addition of air is regulated so that the flame temperature is approximately 1000° C. At this temperature, the hydrocarbons are cracked. In combination with the ensuing water gas reaction in the coke bed of the gas converter 27, a cracked gas is produced, which is formed mainly of carbon monoxide, carbon dioxide, methane and hydrogen. This cracked gas is free of toxic substances and can be delivered to an industrial consumer and burned without harm to the environment.

Part of the cracked gas is returned to the drum 1 via a cracked gas line 36 and the heat exchanger 37. In the heat exchanger 37, the temperature of the cracked gas, which is approximately 1200° C., is cooled down to approximately 550° C., before it is introduced into the drum 1. As a result, overheating of the drum 1 is avoided, and process steam is generated in the heat exchanger 37.

During the operation of the low temperature carbonization drum 1, suitable quantities of material to be carbonized are supplied at short intervals via the sluice 12 at the low temperature carbonization material feeding device 11 through the housing 9 for feeding the low temperature carbonization material and on via a low temperature carbonization material feed pipe 13 into the interior of the drum 1. During the rotation of the drum, the material to be carbonized is circulated continuously and accordingly heated by the hot cracked gas. Via spiral-shaped blades disposed in the interior of the drum 1 but otherwise not shown in detail in the drawing in the interest of simplification, the material to be carbonized is fed continuously towards the right-hand side, as seen in the figure, and gradually changes into so-called low temperature carbonization residue. Finally, this residue is fed by the non-illustrated blade in the interior of the drum 1 into the residue discharge housing 15. There, the residue is fed continuously via the sluice 17 of the residue discharge device 16 into the water-filled collection vessel 21. In this collection vessel 21, the residue cools down. Then it is fed via the transport screw 22 into the transport container 23 that has been made ready.

Because unburned cracked gas is used as the heating medium, there is a savings in terms of burners and fuel costs for the production of heating gas. Furthermore, there is a savings in terms of ring seals needing maintenance, because of the direct introduction of the cracked gas into the interior of the low temperature carbonization drum 1. In the system according to the invention, only one ring seal, respectively, is needed at the housing for feeding the material to be carbonized and at the housing for discharging the residue. Moreover, because of the direct introduction of the cracked gas into the drum 1, the transfer of heat from the cracked gas used as a heat transport medium to the material to be carbonized is optimized. The amount of heat needed for this purpose is reduced even further by the thermal insulator 7, 8 of the drum 1. Because the cracked gas introduced into the drum 1 for heating up the material to be carbonized is admixed with the low temperature carbonization gas produced in the drum, the amount of gas and thus the precipitation conditions for the cyclone 25 that is built into the low temperature carbonization gas line 24 are improved. The heat liberated into the heat exchanger 37 is high-temperature heat and can be utilized both for process steam production and on-site heating purposes.

It is also possible to cool the cracked gas down without the heat exchanger 37 but instead by injecting water or low-temperature steam. An injection device 39 required for this purpose is then installed instead of, or in addition to the heat exchanger 37 in the cracked gas line 36 leading to the drum 1. By injecting water or low-temperature steam, not only is the cracked gas cooled down, but even more important, because of water vapor additionally admixed with the low temperature carbonization gas in the gas converter, the fraction of hydrogen in the cracked gas and thus its calorific or heating value is increased via the water gas reaction with the glowing coke.

The foregoing is a description corresponding, in substance, to German application Pat. No. 36 33 212.7, dated Sept. 30, 1986, International priority of which is being claimed for the instant application, and which is hereby made part of this application. Any material discrepancies between the foregoing specification and the specification of the aforementioned corresponding German application are to be resolved in favor of the latter.

There is claimed:

1. A pyrolysis system for trash and refuse utilization having a heated low temperature carbonization drum with a device for feeding material to be carbonized located at one end face of the drum, a residue discharge device at the other end face of the drum, a low temperature carbonization gas exhaust, and a gas converter connected to the low temperature carbonization gas exhaust for converting the low temperature carbonization gas into cracked gas, comprising means for supplying to the low temperature carbonization drum part of a quantity of cracked gas flowing out of the gas converter as a heat carrier.

2. A pyrolysis system according to claim 1, including means for conducting through the drum the cracked gas supplied to the drum for directly heating the material to be carbonized in counterflow to the material, and means for exhausting together the thus spent cracked gas with the low temperature carbonization gas.

3. A pyrolysis system according to claim 1, including means for conducting the cracked gas supply to the drum through a heat exchanger preceding the drum on the cracked gas side, for reducing the temperature of the cracked gas.

4. A pyrolysis system according to claim 1, including means for injecting water into the cracked gas flowing to the drum for reducing the temperature of the cracked gas flowing to the drum.

5. A pyrolysis system according to claim 1, including a dust precipitator built into a low temperature carbonization gas line leading from said drum to said gas converter.

6. A pyrolysis system according to claim 5, wherein said dust precipitator is a cyclone.

7. A pyrolysis system according to claim 1, including hollow lines communicating with said drum for supplying the cracked gas for indirectly heating said drum.

8. A pyrolysis system according to claim 1, wherein a thermal insulator envelops said drum in a circumferential region thereof.

9. A pyrolysis system according to claim 1, including means for feeding combustion gas derived from outside the system into the low temperature carbonization gas line, for starting up the system.

* * * * *

UNITED STATES PATENT AND TRADEMARK OFFICE

CERTIFICATE OF CORRECTION

PATENT NO. : 4,840,129

DATED : June 20, 1989

INVENTOR(S) : Jelinek, Horst

It is certified that error appears in the above—identified patent and that said Letters Patent is hereby corrected as shown below:

In the title page, item (73)

"Assignee: Siemens Aktiengesellschaft, Berlin and Munich, Fed. Rep. of Germany"

should read:

-- Assignee: Kraftwerk Union-Umwelttechnik GmbH, Stuttgart, Fed. Rep. of Germany--.

Signed and Sealed this

Sixth Day of April, 1993

*Attest:*

STEPHEN G. KUNIN

*Attesting Officer*

*Acting Commissioner of Patents and Trademarks*